US006655280B2

(12) United States Patent
Cartellieri et al.

(10) Patent No.: US 6,655,280 B2
(45) Date of Patent: Dec. 2, 2003

(54) INKING UNIT IN A PRINTING MACHINE HAVING A CHAMBERED DOCTOR BLADE AND MULTIPLE INKING ZONES

(75) Inventors: Alexander Cartellieri, Heidelberg (DE); Oliver Gottschalt, Ludwigshafen (DE); Michael Kohlmann, Frankenthal (DE); Erich Zahn, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/045,252

(22) Filed: Jan. 14, 2002

(65) Prior Publication Data

US 2002/0092434 A1 Jul. 18, 2002

(30) Foreign Application Priority Data

Jan. 12, 2001 (DE) ..... 101 01 133

(51) Int. Cl.[7] ..... B41F 31/04

(52) U.S. Cl. ..... 101/365; 101/350.6; 101/366; 101/DIG. 47; 101/352.13

(58) Field of Search ..... 101/350.5, 350.6, 101/352.13, 365, 366

(56) References Cited

U.S. PATENT DOCUMENTS

| | | | | |
|---|---|---|---|---|
| 4,958,561 A | | 9/1990 | Grosshauser et al. | |
| 5,010,815 A | | 4/1991 | Weisbrod et al. | |
| 5,058,502 A | | 10/1991 | Köbler et al. | |
| 5,121,689 A | * | 6/1992 | Fadner | 101/365 |
| 5,218,905 A | | 6/1993 | Bolte et al. | |
| 5,239,925 A | * | 8/1993 | Bobo | 101/366 |
| 5,297,490 A | * | 3/1994 | Schneider et al. | 101/365 |
| 5,400,710 A | * | 3/1995 | Ehrhard | 101/363 |
| 5,791,248 A | * | 8/1998 | Atkins et al. | 101/350.6 |
| 5,842,416 A | | 12/1998 | Olawsky et al. | |
| 6,089,159 A | * | 7/2000 | Gorter | 101/366 |
| 6,439,116 B1 | * | 8/2002 | Schafer et al. | 101/350.6 |

FOREIGN PATENT DOCUMENTS

| | | |
|---|---|---|
| DE | 37 04 433 C2 | 3/1988 |
| DE | 39 06 647 A1 | 5/1989 |
| DE | 38 00 411 C2 | 7/1989 |
| DE | 41 08 883 A1 | 9/1992 |
| DE | 41 15 026 A1 | 11/1992 |
| DE | 197 17 746 A1 | 11/1997 |
| EP | 0 315 091 B1 | 5/1989 |
| EP | 0 752 311 B1 | 1/1997 |

OTHER PUBLICATIONS

Dr. W. Neumann: "Rasterwalzenauftragsverfahren mit Druckkammerrakel—ein Beschichtungswerkzeug auch für strahlenchemisch härtende Systeme" [screen roller application method with a pressure chamber doctor blade—an application tool for radiolytically curing systems], *Coating*, No. 12, 1996, pp. 464–468.

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

An inking unit in a printing machine includes a screen roller and an ink metering system subdivided into inking zones and assigned to the screen roller for performing zonal ink metering on the screen roller, the ink metering system having metering elements disposed so as to be movable relative to one another.

10 Claims, 3 Drawing Sheets

INKING UNIT IN A PRINTING MACHINE HAVING A CHAMBERED DOCTOR BLADE AND MULTIPLE INKING ZONES

BACKGROUND OF THE INVENTION

Field of the Invention

The invention relates to an inking unit in a printing machine, which includes a screen roller and an ink metering system subdivided into inking zones and assigned to the screen roller for zonal ink metering occurring on the latter.

The published German Patent Document DE 41 08 883 A1 describes such an inking unit, which has a doctor blade provided with temperature control devices and cooperating with the screen roller. The doctor blade is subdivided into thermally insulated zones, each of which is heatable selectively by one of the temperature control devices, so that temperature profiling of the doctor blade takes place. In this inking unit, the doctor blade with the temperature control devices thereof functions as an ink metering system by which a printing ink is supplied in different layer thicknesses to a printing material web, and consequently produce different color tones or shades on the latter.

A disadvantage of this heretofore known inking unit is that it is suitable only for inks having a viscosity which is highly temperature-dependent.

Inking units further known in the prior art are described in the documents cited hereinbelow.

The European Patent Document EP 0 315 09 B1 describes an inking unit having a chambered doctor blade, in the ink distribution chamber of which a single profiled element is pivotably arranged.

The European Patent Documents DE 37 04 433 C2 and DE 38 00 411 C2 (EP 0 324 141 B1) describe inking units with a chambered doctor blade having an antechamber.

None of the inking units described in the aforecited documents permit a zonally different ink metering of a printing ink having a viscosity that is of low temperature dependence.

The published European Patent Document EP 0 752 311 B1 describes an inking unit which does not correspond to the generic type described in the introduction hereto, this inking unit having an ink metering system subdivided into inking zones and assigned to an ink duct roller, the metering system comprising a metering roller engageable by a metering doctor blade and being formed with fine recesses on the circumferential surface thereof for receiving printing ink therein.

Further pertinent prior art is described in an article entitled "Rasterwalzenauftragsverfahren mit Druckkammerrakel ein Beschichtungswerkzeug auch für strahlungschemisch härtende Systeme" ("Screen-roller application method using pressurized chambered doctor blades—a coating tool also for systems curing by radiation chemistry") by Dr W. Neumann, printed in the journal "Coating", Issue December 1996, the article referring to a presentation made at the 21st Münich Gluing and Finishing Seminar, and mentioning line screen rollers.

SUMMARY OF THE INVENTION

Starting from the aforementioned prior art, it is an object of the invention to provide an inking unit of the general type described at the introduction hereto which is also suitable for printing inks having a viscosity that is comparatively minimally temperature-dependent.

With the foregoing and other objects in view, there is provided, in accordance with one aspect of the invention, an inking unit in a printing machine, comprising a screen roller and an ink metering system subdivided into inking zones and assigned to the screen roller for performing zonal ink metering on the screen roller, the ink metering system having metering elements disposed so as to be movable relative to one another.

In accordance with another feature of the invention, the inking unit includes a chambered doctor blade unit bearing on the screen roller, the doctor blade unit having a working doctor blade and a closing doctor blade.

In accordance with a further feature of the invention, the metering elements are disposed in an ink chamber formed in the chambered doctor blade unit.

In accordance with an added feature of the invention, the metering elements are disposed at locations selected from the group thereof consisting of close to and on the working doctor blade.

In accordance with an additional feature of the invention, the inking unit includes an antechamber provided at a location selected from the group thereof consisting of close to and on the closing doctor blade.

In accordance with yet another feature of the invention, the antechamber narrows at an acute wedge angle towards the closing doctor blade.

In accordance with yet a further feature of the invention, the antechamber has a widened chamber section located between an inlet gap and an overflow channel.

In accordance with yet an added feature of the invention, the inking unit includes an adjustable throttle valve assigned to the chambered doctor blade at an outlet side thereof.

In accordance with yet an additional feature of the invention, the screen roller is formed with a helical line screen.

In accordance with a concomitant aspect of the invention, there is provided a printing machine having an inking unit comprising a screen roller and an ink metering system subdivided into inking zones and assigned to the screen roller for zonal ink metering performable on the screen roller, the ink metering system having metering elements disposed so as to be movable relative to one another.

Each of the metering elements is assigned to one of the inking zones and controls the ink supply into the respective inking zone. By manual or motorized adjustment of the metering elements in relation to one another, a different metered quantity of the printing ink can be set in each of the inking zones. The printing ink, in terms of the viscosity thereof, can be temperature-dependent only to a comparatively little extent.

The inking unit according to the invention is particularly well suited for use in a flexographic printing unit.

Other features which are considered as characteristic for the invention are set forth in the appended claims.

Although the invention is illustrated and described herein as embodied in an inking unit in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
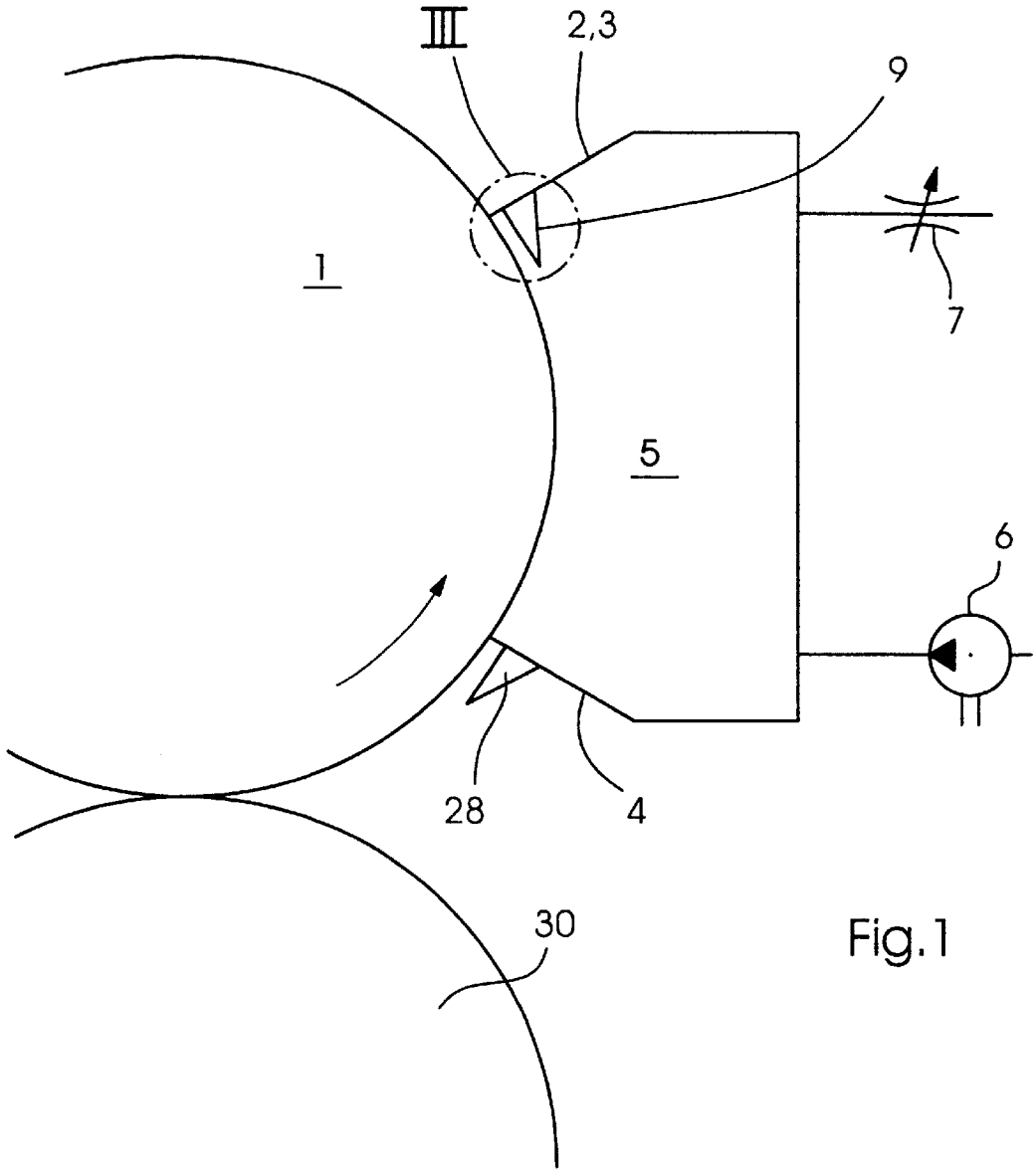
FIG. 1 is a diagrammatic side elevational view of an inking unit according to the invention incorporated in a printing machine.

Referring now to the drawings and, first, particularly to FIG. 1 thereof, there is shown therein an inking unit in a printing machine, which has a screen roller 1 and a diagrammatically illustrated chambered doctor blade unit 2 engaging therewith as a metering doctor blade. The chambered doctor blade unit 2 has a negatively aligned knife-like working doctor blade 3 and a positively aligned knife-like closing doctor blade 4 which bound or define an ink chamber 5 into which the screen roller 1 dips.

An inlet to the ink chamber 5 is connected to a feed pump 6 which produces an excess or positive pressure of a printing ink or some other coating liquid, which is used instead of the printing ink, in the ink chamber 5. The variable magnitude of the excess or positive pressure is adjustable to within the range of from 0 to 1 bar by a throttle valve 7 connected to an outlet from the ink chamber 5. The throttle valve 7 assigned to the chambered doctor blade 2 on the outlet side, and having a printing-ink volume flow passing adjustably therethrough, advantageously avoids any necessity for a second pump.

Figure 6:
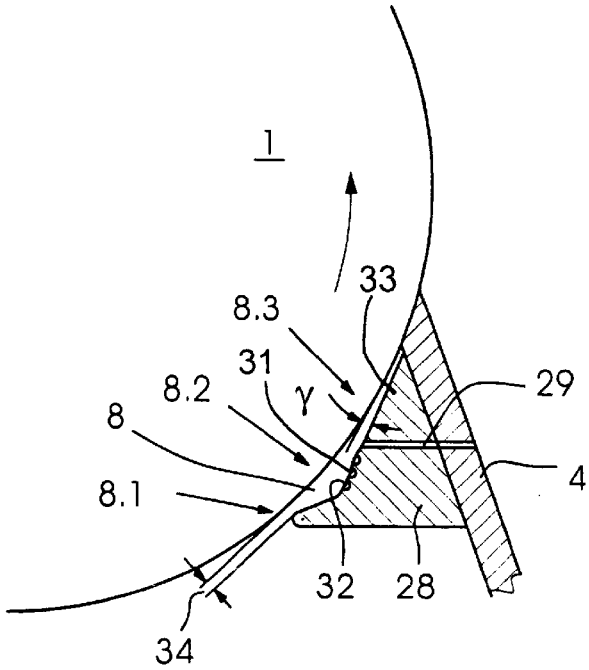
FIG. 6 is an enlarged fragmentary view of FIG. 1 showing an antechamber of the chambered doctor blade.

Constituent parts of the chambered doctor blade unit 2 also include an antechamber 8, as shown in FIG. 6, which is located on the side of the closing doctor blade 4 opposite the ink chamber 5, and a zonally subdivided ink metering system 9, which is assigned to the same roller as the metering doctor blade (chambered doctor blade unit 2), namely the screen roller 1, and which is disposed inside the ink chamber 5. The screen roller 1 is in rolling contact with a cylinder 30, which is a printing-form or blanket cylinder or is in rolling contact with such a cylinder. A flexographic printing form, for example, can be clamped on the cylinder 30.

Figure 2:
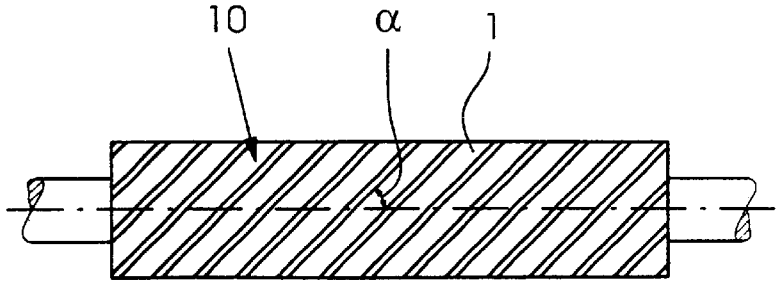
FIG. 2 is an axial elevational view of a line screen roller and a chambered doctor blade of the inking unit.

FIG. 2 shows a pitch angle $\alpha$ of 30° to 60° (preferably 45°) of helically extending screen lines of a line screen 10 of the screen roller 1. In cooperation with the antechamber 8, which is arranged on or close to the closing doctor blade 4, the line screen 10 prevents undesired entrainment of air into the ink chamber 5, and foaming of the printing ink present in the latter much more effectively than would be possible with a chambered doctor blade without an antechamber and a screen roller with a blank screen.

Figure 3:
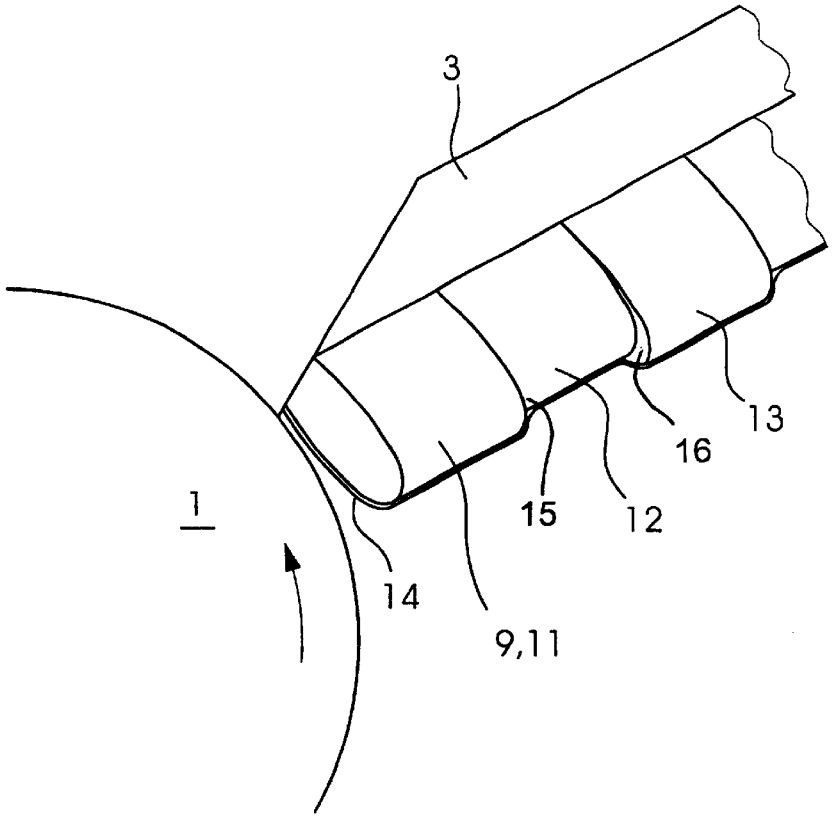
FIG. 3 is a fragmentary enlarged perspective view of FIG. 1, showing, within the phantom circle III, an ink metering system integrated into a chambered doctor blade.

FIG. 3 shows the ink metering system 9 arranged beside the screen roller 1 in a detailed illustration wherein a lateral closing piece belonging to the chambered doctor blade unit 2 has not also been illustrated, in order to avoid obstructing the ink metering system 9. The ink metering system 9, which is subdivided over the printing width into different mutually adjacently disposed inking zones A, B, C, includes a row of metering elements 11, 12, 13 arranged axially parallel to the screen roller 1, each of the metering elements 11, 12, 13 being mounted in an articulated manner in the chambered doctor blade unit 2 so as to be adjustable relative to the screen roller 1 independently of the others. The metering elements 11, 12 and 13 are arranged eccentrically with respect to the ink chamber 5, close to or on a working doctor blade 3. In particular, the metering elements 11, 12 and 13 are arranged very close to a wiping edge of the working doctor blade 3, which bears on the screen roller 1, and projects from the inside of the working doctor blade 3. A foil-like or lamella-like covering strip 14 for covering joints 15, 16 between the metering elements 11, 12, 13 is arranged on the undersides thereof, facing towards the screen roller 1.

Figure 4:
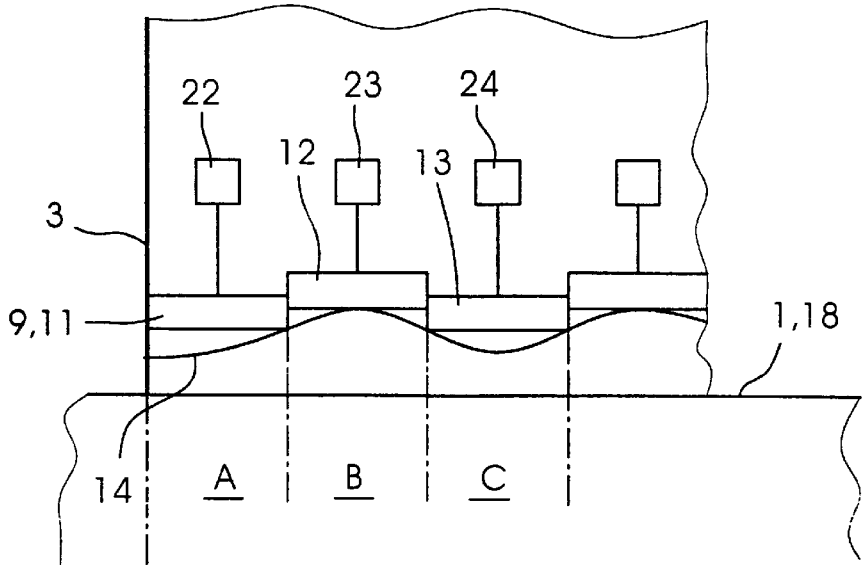
FIG. 4 is a fragmentary diagrammatic side elevational view of metering elements of the ink metering system set in accordance with a given ink profile.

FIG. 4 shows that each of the metering elements 11, 12 and 13 arranged in the ink chamber 5 is assigned to one of the inking zones A, B and C, respectively, in order to adjust a hydrodynamic static pressure of the printing ink in the respective inking zone A, B, C. The static pressures of different magnitudes in the inking zones A, B and C correspond to a non-illustrated ink profile which depends upon a printed image and is generated within the ink chamber 5 by the ink metering system 9, in particular between the ink metering system 9 and a circumferential surface 18 of the screen roller 1, which is provided with the line screen 10. The covering strip 14 is not only used for sealing off the joints 15 and 16, but also, in the region thereof, effects continuous transitions from inking zone to inking zone in the ink profile.

In the inking zone A, the metering element 11 has been brought closer to the circumferential surface 18 than the metering element 12 in the inking zone B. Consequently, the layer thickness of the ink profile in the inking zone A is paradoxically greater than in the inking zone B. The layer thicknesses of the ink profile in the inking zones A, B, C behave proportionately to the static pressures in the corresponding inking zones A, B, C. The static pressure in the inking zone A is consequently greater than that in the inking zone B. This results in a metered quantity of the printing ink 8 on the screen roller 1 within the inking zone A that is greater than within the inking zone B. Thus, the screen lines of the line screen 10 in the region of the inking zone A are overfilled with a meniscus of the printing ink to a greater extent than in the region of the inking zone B. Within one and the same operating mode, there initially occur, simultaneously, on the one hand, ink metering to different extents in the inking zones A, B, C, the metering elements 11, 12, 13, together with the circumferential surface 18, determining different gap widths, and, on the other hand, excess printing ink is wiped off by the metering doctor blade (the chambered doctor blade 2) from the circumferential surface engaged by the metering doctor blade at that time.

Figure 5:
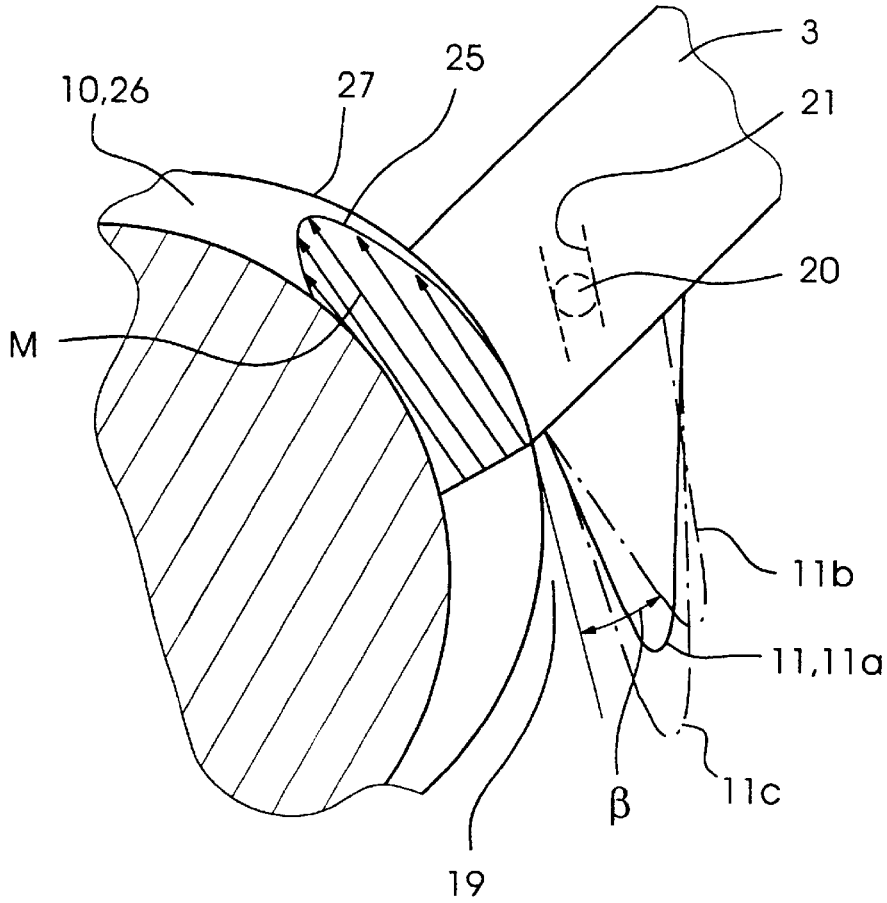
FIG. 5 is an enlarged fragmentary, diagrammatic view, partly in perspective, of FIG. 3, showing various possibilities for adjusting the respective metering elements.

Referring to FIG. 5, with the aid of the metering element 11, the mounting, the driving, the shaping and various positions of each one of the metering elements 11, 12, 13 are described and explained hereinafter, by way of example. The metering element 11 has a nose-shaped and wedge-shaped construction, respectively, and defines or limits a wedge-shaped accumulation or damming chamber 19 which narrows towards the working doctor blade 3. The wiping edge of the working doctor 3 determines the position of a tangent which, together with the flat underside of the metering element 11, forms an acute accumulation angle $\beta$ which determines the static pressure of the printing ink within the accumulation chamber 19 and, therefore, the layer thicknesses of the ink profile. It is assumed that, if the accumulation angle (position 11*b*) is set so as to be relatively large, the static pressure is of a different magnitude than when the accumulation angle β (position 11*a*) is set so as to be relatively small. For the purpose of continuously adjusting the accumulation angle β, the metering element 11 is pivotable about a rotary joint 20 of the mounting.

The static pressure within the accumulation chamber 19 and, therewith, the relative flow velocity of the printing ink in the groove-shaped screen lines in the line screen 10 is adjustable, however, not only by optional narrowing or widening of the accumulation chamber 19, but also by the optional shortening or lengthening thereof. A sliding joint 21 belonging to the mounting permits continuous displacements of the metering element 11 away from the working doctor blade 3 into a position 11*c* in order to lengthen the accumulation chamber 19, and back into the position 11*a* again towards the working doctor blade 3 in order to shorten the accumulation chamber 19. It is assumed that if a metering element 11 projects far into the inking chamber 5 (position 11*c*), the static pressure and consequently the flow velocity in the screen roller 1 is of a different magnitude than in the case of a metering element 11 projecting a lesser distance into the ink chamber 5.

As already mentioned hereinbefore, each of the other metering elements 12, 13 is, of course, likewise mounted articulatedly by a rotary joint and/or a sliding joint. Deviating from the illustrated exemplary embodiment, use of a flexible joint instead of the rotary joint 20 or instead of the sliding joint 21 is also conceivable, it being possible for the metering elements 11, 12, 13 to be constructed as spring tongues.

FIG. 5 further shows a velocity profile 25 of liquid layers of the printing ink in the region between the working doctor blade 3 and the screen roller 1 and in a sectional view of the screen line 26 belonging to the line screen 10. The working doctor blade 3 is set against a screen or cell wall 27 belonging to the line screen 10 and separating the screen line 26 from an adjacent non-illustrated screen line. The screen line 26 and the screen or cell wall 27 extend obliquely or at an inclination to the plane of FIG. 5, in correspondence with the pitch angle α (note FIG. 2). The screen line 26, therefore, constitutes a connection between the ink chamber 5 and the surroundings wherein normal air pressure prevails, the printing ink flowing due to the positive pressure in the ink chamber 5. The printing ink in the screen line 26 is, therefore, not only pressed through and out of the ink chamber 5 by the rotation of the screen roller 1 and, accordingly, conveyed past the working doctor blade 3, but is additionally pressed through between the working doctor blade 3 and the screen roller 1 by the positive pressure, namely the static positive pressure in the ink chamber 5 and the dynamic positive pressure in the accumulation chamber 19.

Consequently, it may be assumed that the velocity profile 25 has the following properties: at the base of the screen line 26, the flow velocity of the printing ink is equal to zero, so that thereat the printing ink does not have a differential velocity relative to the base of the screen line 26 and moves together with the latter, relative to the stationary chambered doctor blade unit 2, at the circumferential surface speed of the base. The liquid layer of the printing ink located closest to the working doctor blade 3 has no differential velocity relative to the stationary working doctor blade 3, so that this liquid layer does not move. The velocity profile 25 has a velocity maximum M, the magnitude of which depends not only on the rotational speed of the screen roller 1 and the positive pressure set in the ink chamber 5, but also on the static pressure in the accumulation chamber 19, i.e., also on the positions 11*a*, 11*b*, 11*c* of the metering element 11. The velocity maximum M has a higher value than the circumferential surface speed of the base of the screen line 26, so that the at least approximately parabolic shape of the velocity profile 25 between the base thereof and the working doctor blade 3 results.

In each of the inking zones A, B, C, a velocity maximum M that is different from those of the others of these inking zones can be set by the metering element 11, 12 or 13 assigned to the respective inking zone A, B or C being adjusted into a position 11*a*, 11*b*, or 11*c* corresponding to the respectively desired velocity maximum. From the functional dependence of the extent of filling of the screen line 26 from the velocity maximum M, from the functional dependence thereof upon the hydrodynamic static pressure in the accumulation chamber 19, and from the hydrodynamic static pressures set differently in accordance with a printing image by the metering elements 11, 12, 13, there result extents of filling of the screen line 26 or of the line screen 10 which differ from inking zone to inking zone.

For example, an averaged mean velocity of all the liquid layers of the velocity profile 25 can be higher than the circumferential surface speed of the base of the screen lines 26, so that, after the printing ink has emerged from the chambered doctor blade 2, i.e., after the line section of the screen line 26 containing the printing ink has passed through and under the working doctor blade 3, a meniscus-shaped overfilling of the screen line 26 in the region of the line section of the desired magnitude results. The meniscus-shaped overfilling is a bulging or arching of the printing ink above the radial level of the screen or cell wall 27.

The metered quantity of the printing ink to be transferred to the screen roller 1 is presettable equally for all the inking zones A, B, C by the throttling valve 7, by suitably setting or adjusting the positive pressure in the ink chamber 5. Furthermore, fine zonal adjustment of the metered quantity per inking zone A, B, C by the metering elements 11, 12, 13 is possible. It is likewise possible to regulate the ink metering system 9 as a function of rotational speed changes of the screen roller 1, so that the hydrodynamic static pressures produced by the metering elements 11, 12, 13, which would otherwise be influenced in an undesired manner by the rotational speed changes, maintain the constant static pressure values thereof during any rotational speed change. From the static pressures independent of the rotational speed, there result ink layer thicknesses, which are independent of rotational speed, on the screen roller 1, the cylinder 30 and in the printed image.

FIG. 6 shows the construction of the antechamber 8 into which the screen roller 1 dips. The antechamber 8 is bounded by the circumferential surface 18, the closing doctor blade 4 and a profiled strip 28 which is disposed on the outside of the closing doctor blade 4, near the wiping edge of the latter. The antechamber 8, which narrows in the direction towards the closing doctor blade 4, is subdivided into a plurality of chamber sections 8.1, 8.2, 8.3.

The outermost, first chamber section 8.1 is a narrow inlet gap 34 which is formed by a nose-shaped projection of the profile of the profiled strip 28.

The second chamber section 8.2 is a hollow throat-shaped widening located between the nose-shaped projection and an overflow channel 29 and merging continuously into the third chamber section 8.3 wherein capillary forces prevail. In the region of the second chamber section 8.2, the profiled strip 28 has a hydrophobic inner surface 31, which is curved concavely and into which there are introduced transverse grooves 32 approximately axially parallel to the screen roller 1 and extending over all the inking zones A, B, C.

In the region of the third chamber section 8.3, the profiled strip 28 has a hydrophilic inner surface 33. The wiping edge of the closing doctor blade 4 determines the position of a tangent which, together with the inner surface 33, forms an acute wedge angle γ of the antechamber 8. This angle establishes a very flat wedge shape for the third chamber section 8.3 which lies closest to the closing doctor blade 4, narrows in the direction towards the latter, and extends from the closing doctor blade 4 as far as the overflow channel 29.

The chamber sections 8.1, 8.2, 8.3 extend in the illustrated profiling over the entire printing width, i.e., over all the inking zones A, B, C. The overflow channel 29, which passes through the profiled strip 28 and the closing doctor blade 4 as a borehole or as a slot, connects the antechamber 8 to the ink chamber 5 so that a small quantity of the printing ink can flow continuously out of the ink chamber 5 into the antechamber 8. A plurality of such overflow channels can be provided over the printing width, for example, one of such overflow channels for each inking zone A, B, C.

The effect or action of the antechamber 8 is as follows:

The printing ink filled into the line screen 10 by the chambered doctor blade unit 2 is only partly transferred from the screen roller 1 to the cylinder 30. Due to the liquid splitting in the roller nip formed by the screen roller 1 together with the cylinder 30, complete emptying of the line screen 10 does not take place, and a non-transferred residual quantity of ink remains on the screen roller 1. In the course of the further rotation of the latter, the residual quantity of ink is transported to the antechamber 8. The gap width of the inlet gap 34 is dimensioned so that the entire residual quantity of ink located in the line screen 10 of the screen roller 1 is transported into the antechamber 8, and the air expelled from the antechamber 8 by the residual quantity of ink can escape from the antechamber 8 through the inlet gap 34. The residual quantity of ink accumulates in the region of the third chamber section 8.3 wherein a hydrodynamic static pressure of approximately 0.6 bar prevails. Due to this hydrodynamic static pressure in the third chamber section 8.3, the residual quantity of ink is at least partially pressed back into the line screen 10, the screen lines thereof being completely filled with the printing ink again. At the same time, the air previously present in the screen lines is displaced from the screen lines and escapes through the inlet gap 34, as already mentioned hereinbefore. The displaced air therefore does not pass into the ink chamber 5, so that a formation of foam in the coating liquid in the ink chamber 5 and, consequently, a change in viscosity, is advantageously avoided.

If an excessively high residual quantity of ink passes into the antechamber 8, the volume of which exceeds that of the third chamber section 8.3, so that the latter threatens to overflow, pressure equalization between the chambers 5 and 8 takes place, the excessive part of the residual quantity of ink flowing out of the antechamber 8 into the ink chamber 5 through the overflow channel 29. In this case, the second chamber section 8.2 functions as a temporary or intermediate storage for the excessive part of the residual quantity of ink which is circulated in the second chamber 8.2 due to the rotation of the screen roller 1.

If, however, an excessively low residual quantity of ink passes into the antechamber 8, the volume thereof being insufficient for filling the third chamber section 8.3 completely as far as the overflow channel 29, an opposite pressure equalization takes place between the chambers 5 and 8, a differential volume of the printing ink, missing from the residual quantity of ink for the complete filling of the third chamber section 8.3, flowing out of the ink chamber 5 into the antechamber 8 through the overflow channel 29.

The hydrophobic nature of the inner surface 31 ensures that droplets of the printing ink, which is preferably a water-based printing ink or a water-based varnish, run off or drip off the inner surface 31 in the direction towards the inlet gap 34 and, in the region of the inlet gap 34, are picked up by the rotating screen roller 1, are entrained and transported into the third chamber section 8.3 again. Assurance is therefore absolutely provided that no droplets of the printing ink can emerge from the inlet gap 34, and a problem which has existed for a long time, namely that of the dripping closing doctor blade, has thus now been solved.

We claim:

1. An inking unit in a printing machine, comprising a screen roller and an ink metering system subdivided into inking zones and assigned to said screen roller for performing zonal ink metering on said screen roller, said ink metering system having metering elements disposed so as to be movable relative to one another, and a chambered doctor blade unit bearing on said screen roller, said doctor blade unit having a working doctor blade and a closing doctor blade.

2. The inking unit according to claim 1, wherein said metering elements are disposed in an ink chamber formed in said chambered doctor blade unit.

3. The inking unit according to claim 1, wherein said metering elements are disposed at locations selected from the group thereof consisting of close to and on said working doctor blade.

4. The inking unit according to claim 1, including an antechamber provided at a location selected from the group thereof consisting of close to and on said closing doctor blade.

5. The inking unit according to claim 4, wherein said antechamber narrows at an acute wedge angle towards said closing doctor blade.

6. The inking unit according to claim 4, wherein said antechamber has a widened chamber section located between an inlet gap and an overflow channel.

7. The inking unit according to claim 1, including an adjustable throttle valve assigned to said chambered doctor blade unit at an outlet side thereof.

8. The inking unit according to claim 1, wherein said screen roller is formed with a helical line screen.

9. A printing machine having an inking unit comprising a screen roller and an ink metering system subdivided into inking zones and assigned to said screen roller for zonal ink metering performable on said screen roller, said ink metering system having metering elements disposed so as to be movable relative to one another, and a chambered doctor blade unit bearing on said screen roller, said doctor blade unit having a working doctor blade and a closing doctor blade.

10. An inking unit in a printing machine, comprising a screen roller and an ink metering system subdivided into inking zones and assigned to said screen roller for performing zonal ink metering on said screen roller, said ink metering system having metering elements being movable relative to one another and each of said metering elements being adjustable into several different metering positions.

* * * * *